US012241033B2

(12) United States Patent
de Vroom et al.

(10) Patent No.: US 12,241,033 B2
(45) Date of Patent: Mar. 4, 2025

(54) FUEL COMPOSITIONS WITH ENHANCED STABILITY AND METHODS OF MAKING SAME

(71) Applicant: SHELL OIL COMPANY, Houston, TX (US)

(72) Inventors: Cathelijne Anneroos de Vroom, Amsterdam (NL); Aldo Caiazzo, Amsterdam (NL); Claudette Salomons, Amsterdam (NL); Plamen Yankulov, Sofia (BG)

(73) Assignee: SHELL USA, INC., Houston, TX (US)

( * ) Notice: Subject to any disclaimer, the term of this patent is extended or adjusted under 35 U.S.C. 154(b) by 204 days.

(21) Appl. No.: 17/625,822

(22) PCT Filed: Jul. 28, 2020

(86) PCT No.: PCT/EP2020/071281
§ 371 (c)(1),
(2) Date: Jan. 10, 2022

(87) PCT Pub. No.: WO2021/018895
PCT Pub. Date: Feb. 4, 2021

(65) Prior Publication Data

US 2022/0259510 A1 Aug. 18, 2022

Related U.S. Application Data

(60) Provisional application No. 62/880,374, filed on Jul. 30, 2019.

(51) Int. Cl.

| | |
|---|---|
| ***C10L 1/19*** | (2006.01) |
| ***C10G 75/04*** | (2006.01) |
| ***C10L 1/08*** | (2006.01) |
| ***C10L 10/00*** | (2006.01) |

(52) U.S. Cl.
CPC ..... *C10L 1/19* (2013.01); *C10G 75/04* (2013.01); *C10L 1/08* (2013.01); *C10L 10/00* (2013.01); *C10G 2300/107* (2013.01); *C10G 2300/1077* (2013.01); *C10G 2300/206* (2013.01); *C10G 2300/302* (2013.01); *C10G 2300/304* (2013.01); *C10G 2300/80* (2013.01); *C10G 2400/16* (2013.01); *C10L 2200/0438* (2013.01); *C10L 2200/0476* (2013.01); *C10L 2200/0484* (2013.01); *C10L 2230/14* (2013.01); *C10L 2290/24* (2013.01)

(58) Field of Classification Search
CPC ..... C10G 29/22; C10G 75/00; C10G 75/04; C10G 2300/107; C10G 2300/1077; C10G 2300/206; C10G 2300/302; C10G 2300/304; C10G 2300/80; C10G 2400/16; C10L 1/04; C10L 1/08; C10L 1/19; C10L 10/00; C10L 2200/0438; C10L 2200/0476; C10L 2200/0484; C10L 2230/14
See application file for complete search history.

(56) References Cited

U.S. PATENT DOCUMENTS

| | | | | |
|---|---|---|---|---|
| 5,393,309 | A | 2/1995 | Cherpeck | |
| 8,876,923 | B2 | 11/2014 | Cherrillo et al. | |
| 9,803,152 | B2 | 10/2017 | Kar et al. | |
| 9,845,434 | B2 | 12/2017 | Pinappu et al. | |
| 2009/0300974 | A1 | 12/2009 | Burgazli | |
| 2011/0072715 | A1* | 3/2011 | Hanks | C10G 3/50 44/389 |
| 2015/0052802 | A1 | 2/2015 | Pinappu et al. | |
| 2016/0160139 | A1* | 6/2016 | Robinson | C10G 45/02 208/15 |
| 2018/0223227 | A1 | 8/2018 | Barreau et al. | |
| 2019/0185772 | A1 | 6/2019 | Berkhous et al. | |

FOREIGN PATENT DOCUMENTS

| | | | | |
|---|---|---|---|---|
| EP | 0147240 | A2 | 7/1985 | |
| EP | 0482253 | A1 | 4/1992 | |
| EP | 0613938 | A | 9/1994 | |
| GB | 960493 | A | 6/1964 | |
| JP | 2007231121 | A | 9/2007 | |
| JP | 5110607 | B2 * | 12/2012 | B01J 23/755 |
| WO | 9842808 | A1 | 10/1998 | |
| WO | 2015044905 | A1 | 4/2015 | |

(Continued)

OTHER PUBLICATIONS

English-language machine translation of JP 5110607 (Year: 2012).*
Office Action Received for Chinese Application No. 202080053512.8, Mailed on Dec. 22, 2022, 25 Pages(9 Pages of English Translation and 16 Pages of Official Copy).
International Search Report and Written Opinion received for PCT Patent Application No. PCT/EP2020/071281, Mailed on Oct. 26, 2020, 11 pages.

(Continued)

*Primary Examiner* — James C Goloboy
(74) *Attorney, Agent, or Firm* — Shell USA, Inc.

(57) ABSTRACT

Method to improve or maintain stability and/or compatibility of a residual hydrocarbon fuel comprising: (a) blending at least 5-95% m/m of a residual hydrocarbon component with at least 5-80% m/m of a fatty acids alkyl esters component or (b) blending at least 5-80% m/m of a fatty acids alkyl esters component with a stable residual fuel composition comprising (i) at least 5-95% m/m of a residual hydrocarbon component and (ii) up to 90% m/m of a non-hydroprocessed hydrocarbon, a hydroprocessed hydrocarbon or any combination thereof; wherein the fatty acids alkyl esters component is blended with the stable residual fuel composition before at least one other fuel composition that decreases the asphaltenes solvency power of the residual fuel composition is added thereto.

8 Claims, 3 Drawing Sheets

(56) References Cited

FOREIGN PATENT DOCUMENTS

WO 2016089590 A1 6/2016

OTHER PUBLICATIONS

Vermeire et al., "Everything You Need to Know About Marine Fuels", Jun. 30, 2012, 32 pages, XP055537543.
Office Action Received for Japanese Application No. 2022-506108, Mailed on May 23, 2024, 09 Pages (05 Pages of English Translation and 04 Pages of Official Copy).

* cited by examiner

FUEL COMPOSITIONS WITH ENHANCED STABILITY AND METHODS OF MAKING SAME

CROSS REFERENCE TO RELATED APPLICATIONS

This is a National stage application of International application No. PCT/EP2020/071281, filed Jul. 28, 2020, which claims priority of U.S. provisional application No. 62/880,374, filed 30 Jul. 2019 which is incorporated herein by reference in its entirety.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of any prior art.

The present disclosure generally relates to marine fuel compositions, specifically marine fuel compositions with enhanced stability comprising at least one residual hydrocarbon component and at least one fatty acids alkyl ester component.

Marine vessels used in global shipping typically run on marine fuels, which can also be referred to as bunker fuels or fuel oil. Marine fuels that are residues-based ("resid-based" or residual) or comprise a residual hydrocarbon component may contain heavy oil fractions that are otherwise difficult and/or expensive to convert to a beneficial use.

Recent specifications around marine fuels with lower sulfur content can result in the use of hydrocarbon streams of different nature as blending components for the finished fuels that meet the required specifications. In such circumstances, achieving the desired fuel stability may be a challenge because blending feedstocks of different compositions which are incompatible may make asphaltenes come out of solution and cause problems, causing instability of the fuel itself. Furthermore, comingling sometimes two stable fuels may result in a non-stable blend in which a flocculation and precipitation of asphaltenes occurs, causing operational problems with the equipment using these fuels.

U.S. Pat. No. 9,803,152 discloses methods for determining the compatibility of various grades of fuel oils, as well as methods for modifying fuel oils to improve compatibility and improved compatibility compositions. It also discloses that the toluene equivalent solvation power of a blend of fuel oils does not vary in a straightforward manner with respect to the toluene equivalent solvation power of the individual blend components.

U.S. Pat. No. 9,845,434 discloses that biological source oils, such as algae oil, stabilize the presence of asphaltenes in petroleum feedstocks, such as crude oil, to help avoid or prevent fouling and/or corrosion in the production, transfer and processing of the petroleum feedstocks.

U.S. Publication No. 20090300974 discloses various additive stabilizers for increasing stability of renewable fuel feed stocks (such as biodiesel) or the blends of petroleum-based fuels with the renewable fuels, noting that bio derived fuels are inherently more oxidatively unstable as compared to petroleum-based fuels and exposure of biodiesel/petroleum diesel blends to air causes oxidation of the fuel.

Thus, it would be desirable to develop fuel compositions with enhanced stability and methods of making same.

SUMMARY

Use of a fatty acids alkyl esters component or method to improve or maintain stability and/or compatibility of a residual hydrocarbon component or a residual fuel composition, said use comprising: (a) blending at least 5% m/m to 95% m/m of a residual hydrocarbon component selected from a group consisting of an atmospheric tower bottoms (ATB) residue optionally with a flash point in a range of 80 to 213° C., a vacuum tower bottoms residues (VTB) optionally with a flash point in a range of 220 to 335° C., and any combination thereof with at least 5% m/m to 80% m/m of a fatty acids alkyl esters component, wherein the fatty acids alkyl esters component is blended with the residual hydrocarbon component before another component that decreases the asphaltenes solvency power of the residual hydrocarbon component is added thereto and wherein at least the blending of the fatty acids alkyl esters component before said another component is added increases the asphaltenes stability reserve and/or stability of the residual hydrocarbon component, wherein the increase in stability reserve and/or stability is at least measured by a decrease in the amount of asphaltenes flocculation and/or precipitation in the residual hydrocarbon component or the residual fuel composition relative to the amount of asphaltenes flocculation and/or precipitation in the same residual hydrocarbon component which (i) does not comprise the fatty acids alkyl esters component or (ii) comprises the fatty acids alkyl esters component blended after said another component has been added; or (b) blending at least 5% m/m to 80% m/m of a fatty acids alkyl esters component with a stable residual fuel composition comprising or optionally consisting essentially of (i) at least 5% m/m to 95% m/m of a residual hydrocarbon component selected from a group consisting of an atmospheric tower bottoms (ATB) residue optionally with a flash point in a range of 80 to 213° C., a vacuum tower bottoms residues (VTB) optionally with a flash point in a range of 220 to 335° C., and any combination thereof and (ii) up to 90% m/m of a non-hydroprocessed hydrocarbon component, a hydroprocessed hydrocarbon component, or any combination thereof, wherein the fatty acids alkyl esters component is blended with the stable residual fuel composition before at least one other fuel composition that decreases the asphaltenes solvency power of the residual fuel composition is added thereto and the combination of the stable residual fuel composition and the at least one other fuel composition forms a blended residual fuel composition, and wherein at least the blending of the fatty acids alkyl esters component before the at least one other fuel composition is added increases the compatibility of said stable residual fuel composition and/or the stability of the blended residual fuel composition, wherein the increase in compatibility of the stable residual fuel composition and/or the stability of the blended residual fuel composition is at least measured by a decrease in the amount of asphaltenes flocculation and/or precipitation in the blended residual fuel composition relative to the amount of asphaltenes flocculation and/or precipitation in the same blended residual fuel composition which (i) does not comprise the fatty acids alkyl esters component or (ii) comprises the fatty acids alkyl esters component blended after the at least one other residual marine fuel composition has been added to the stable residual marine fuel composition.

Optionally, (i) the residual hydrocarbon component blended with the fatty acids alkyl ester component before said another component is added has an asphaltenes solubility level, (ii) the residual hydrocarbon component without the fatty acids alkyl ester component has an asphaltenes solubility level, and (iii) the residual hydrocarbon component blended with the fatty acids alkyl ester component after said another component is added has an asphaltenes solubility level, and the asphaltenes solubility level of (i) is greater than the asphaltenes solubility level of either (ii) or (iii); and Optionally, (i) the blended residual fuel composition comprising the stable residual fuel composition blended with the fatty acids alkyl ester component before the at least one other fuel composition is added has an asphaltenes solubility level, (ii) the blended residual fuel composition comprising with the stable residual fuel composition without the fatty acids alkyl ester component has an asphaltenes solubility level, and (iii) the blended residual fuel composition comprising the stable residual fuel composition blended with the fatty acids alkyl ester component after the at least one other fuel composition is added has an asphaltenes solubility level; wherein the asphaltenes solubility level of (i) is greater than the asphaltenes solubility level of either (ii) or (iii).

Optionally, the asphaltenes solubility is determined by ASTM D4740 and/or the stability is determined using the ASTM D7060 method. Optionally, the increase in stability reserve, stability, and/or compatibility of the residual hydrocarbon component and/or residual fuel composition or final blend of two different fuel compositions through the uses and/or methods described herein can at least be measured or determined by a decrease in the amount of asphaltenes flocculation and/or precipitation in the blends and/or components with the fatty acids alkyl esters component, particularly when added before the addition of another component that can decrease the asphaltene solvency power of the residual hydrocarbon component or residual fuel composition respectively. The decrease in the amount of asphaltenes flocculation and/or precipitation can be measured or determined at least through observation under a microscope, such as under 100× magnification here or by any other suitable methods known to one of ordinary skill, such as those mentioned in this disclosure, including, e.g., ASTM D7060.

The present disclosure also provides for a fuel composition having improved stability or compatibility comprising or consisting essentially of: at least 5% m/m to 95% m/m of a residual hydrocarbon component selected from a group consisting of an atmospheric tower bottoms (ATB) residue optionally with a flash point in a range of 80 to 213° C., a vacuum tower bottoms residues (VTB) optionally with a flash point in a range of 220 to 335° C., and any combination thereof; at least 5% m/m to 80% m/m of a fatty acids alkyl esters component; and up to 90% m/m of a non-hydroprocessed hydrocarbon component, a hydroprocessed hydrocarbon component, or any combination thereof; wherein the fatty acids alkyl esters component is blended with the residual hydrocarbon component before another component that decreases the asphaltenes solvency power of the residual hydrocarbon component is added thereto.

Optionally, for the uses, methods, and compositions provided herein, the non-hydroprocessed component is selected from the group consisting of light cycle oil (LCO), heavy cycle oil (HCO), fluid catalytic cracking (FCC) cycle oil, FCC slurry oil, pyrolysis gas oil, cracked light gas oil (CLGO), cracked heavy gas oil (CHGO), pyrolysis light gas oil (PLGO), pyrolysis heavy gas oil (PHGO), pyrolysis residue (ECR), thermally cracked residue, thermally cracked heavy distillate, coker heavy distillates, vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), and any combination thereof. Optionally, the hydro-processed component is selected from a group consisting of low-sulfur diesel (LSD) having a sulphur content of less than 500 ppmw, ultra low-sulfur diesel (ULSD) having a sulphur content of less than 15 ppmw; hydrotreated LCO; hydrotreated HCO; hydrotreated FCC cycle oil; hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate, hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms, hydrotreated thermally cracked VGO, and hydroprocessed DAO, including hydrotreated hydrocracker DAO, and any combination thereof.

Optionally, for the uses, methods, and compositions provided herein, the fatty acids alkyl esters component is a product of trans-esterification of vegetable oils and/or animal fats with an alcohol, or the esters of a fatty acids derived from naturally occurring oils and fats, and an alcohol. Optionally, the oils and/or fats are selected from the group consisting of Soy Oil, Palm Oil, Rapeseed Oil, Linseed Oil, Coconut Oil, Corn Oil, Cotton Oil, Cooking Oils, including Used Cooking Oils, Waste Cooking Oils, Sunflower Oil, Safflower Oil, Algae Oil, Tallow, Lard, Yellow Grease, Brown Grease, Fish Oils, and any combination thereof. Optionally, the alcohol is selected from the group consisting of linear, branched, alkyl, aromatic, primary, secondary, tertiary, and polyols.

Optionally, for the uses, methods, and compositions provided herein, the residual fuel composition has a sulphur content in a range of about 0.05 to about 3.5% m/m. Optionally, for the uses, methods, and compositions provided herein, the residual fuel composition exhibits at least one or all of the following: a hydrogen sulfide content of at most 2.0 mg/kg; an acid number of at most 2.5 mg KOH per gram; a sediment content of at most 0.1% m/m; a water content of at most 0.5% v/v; an ash content of at most 0.15% m/m; a density at 15° C. in a range of 0.870 to 1.010 g/cm$^3$, a kinematic viscosity at 50° C. in a range of 1 to 700 cSt, a pour point in the range of −30 to 35° C., and a flash point in a range of 60° C. to 130° C. Optionally, for the uses, methods, and compositions provided herein, the Atmospheric Tower Bottoms (ATB) residues exhibit at least one or all of the following: a pour point in a range of −19.0 to 64° C., a flash point in a range of 80 to 213° C.; an acid number of up to 8.00 mg KOH/g; a density at ~15° C. of at most about 1.0 g/cc; and a kinematic viscosity at ~50° C. in a range of 1.75 to 15000 cSt, and the Vacuum Tower Bottom (VTB) residues exhibit at least one of the following: a density at 15° C. in a range of 0.8 to 1.1 g/cc; a pour point in a range of −15.0 to 95° C., a flash point in a range of 220 to 335° C.; an acid number of up to 8.00 mg KOH/g; and a kinematic viscosity at 50° C. in a range of 3.75 to 15000 cSt. Optionally, for the uses, methods, and compositions provided herein, the ATB residues comprise greater than 70% m/m, greater than 80% m/m, or greater than 90% m/m hydrocarbons having carbon numbers greater than C20.

Advantages and other features of embodiments of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The following drawings illustrate certain aspects of some of the embodiments of the invention and should not be used to limit or define the invention.

DETAILED DESCRIPTION

Figure 1:
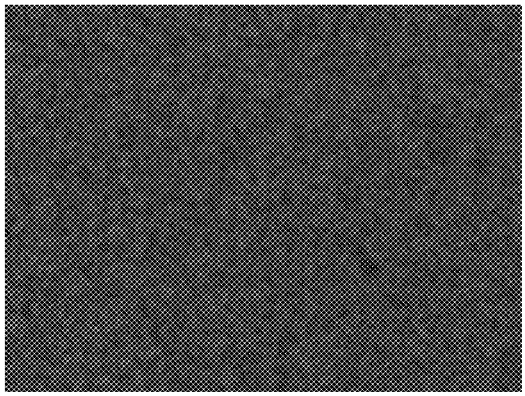
FIG. 1 shows an unstable VTB residual hydrocarbon component from Example 1, which is observed under microscopic magnification of 100×.

The present disclosure generally relates to marine fuels, specifically marine residual fuels with enhanced stability comprising at least one residues component (or a residual hydrocarbon component) and at least one fatty acids alkyl esters, and use of a fatty acids alkyl esters to stabilize a marine fuel comprising at least one residual hydrocarbon component. It has been discovered that adding a fatty acids alkyl esters to a residual hydrocarbon component, and optionally additionally a hydroprocessed or non-hydroprocessed hydrocarbon component, resulted in a fuel compositions with improved asphaltenes solubility and correspondingly, enhanced fuel stability as compared to the same fuel composition but without the fatty acids alkyl esters.

The stability of a residual marine fuel may be defined as the ability of the fuel to not undergo changes during storage which would negatively affect its fitness for purpose and in particular would not cause formation/segregation of insoluble matter (sludge). The sludge formation in marine fuel is a source of operational challenges for the vessel/shipowner, which may range from blocked filters and overloaded fuel pumps to damaged engine parts, such as pistons, rings and liners. Sludge can be a combination of asphaltenes and a number of other materials, including resins, waxes, oxidized or polymerized matter, sediments, water, bio-mass produced by bacteria, etc. and could be formed as a result of chemical, physical and/or biological processes taking place during storage of the marine fuel.

Due at least to the process of producing residual hydrocarbon components, these components typically contain asphaltenes, which are the highest molecular weight molecules commonly found in crude oils. Asphaltenes are typically dark brown to black-colored amorphous solids with complex structures and relatively high molecular weight and varying degree of polarity depending on their origin compared to other crude oil components. They are defined as the fraction that is insoluble in n-heptane but soluble in toluene. Asphaltenes are polar molecules with a predominantly aromatic (condensed aromatic rings) structure.

At least the polar and mostly aromatic character and high molecular weight of asphaltenes lead to their relatively low solubility in non-polar (such as paraffinic) liquid hydrocarbon matrix (or phase) and their relatively high solubility in aromatic liquid hydrocarbon matrix (or phase). Flocculation of asphaltenes in a residual marine fuel can occur when asphaltene molecules begin to aggregate, which eventually leads to precipitation of asphaltenes as dark solid fragments when sufficient amount of asphaltenes have aggregated and fallen out of solution. Either flocculation and/or precipitation of asphaltenes can lead to an unstable fuel composition where the flocculated and/or precipitated asphaltenes (rather than staying in solution) can cause sludge formation.

At least one factor leading to asphaltene flocculation or precipitation in fuel compositions containing a certain amount of asphaltenes is when the solvency power (e.g. aromaticity of the liquid phase in which they are dissolved) is reduced. Not wishing to be bound by theory, the inventors have shown here that use of a fatty acids alkyl esters to improve the solubility of asphaltenes or to increase the solvency power of the liquid fuel matrix can provide for improved fuel stability and potentially compatibility of fuels or components of different properties where asphaltene precipitation from combining such different fuels and/or components is decreased.

Fatty acids alkyl esters, such as fatty acids methyl esters (FAMEs), are oxygen-containing polar compounds of biological origin with combustion properties similar to those of gasoil fuels. When blended with a petroleum-based fuel component, fatty acids alkyl esters can result in a reduction of the greenhouse gas ($CO_2$) emissions from transport, as well as improve solubility of asphaltene of the blended composition, thereby improving the stability and compatibility of the resulting fuel composition as described herein. As noted above, not wishing to be bound by theory, the inventors have shown here that use of a fatty acids alkyl esters component as a blending component with a residual hydrocarbon component can increase the solvency power of the resulting blend towards asphaltenes or other components with limited solubility such as e.g. resins, etc., thereby providing for a fuel composition with increased stability (such as being able to have a higher amount of asphaltene dissolved in the liquid matrix or stay in solution as compared to the same blend but without the fatty acids alkyl esters component).

In addition, the inventors have shown that use of a fatty acids alkyl esters component can also increase the compatibility tolerance or stability reserve of a residual fuel composition towards the addition of paraffinic components (such as cetanes), which can act as viscosity reducers. As noted above, asphaltenes have relatively low solubility in non-polar (such as paraffinic) liquid hydrocarbon matrix (or phase). An increase in the non-polar content of a liquid hydrocarbon matrix, such as the liquid phase of a fuel composition, can decrease the solubility of asphaltenes in the fuel composition or decrease the solvency power of the fuel composition towards asphaltenes, meaning the tolerance for the addition of non-polar components of that fuel composition is relatively low. However, adding a fatty acids alkyl esters component to a stable fuel composition or a stable residual hydrocarbon component can increase the ability of the stable fuel composition or residual hydrocarbon component to remain stable even with the addition of non-polar components (e.g., paraffinic components). The stability or instability of a fuel composition or component can be determined by known methods which generally correlate to the amount of asphaltenes not completely in solution, e.g., flocculated or precipitated.

Further, the inventors have also shown that use of a fatty acids alkyl esters component with a stable fuel composition comprising a residual hydrocarbon component can increase the stability reserve of such fuel composition as compared to the same fuel composition without the fatty acids alkyl esters component. A stable fuel composition may be considered incompatible with another stable fuel composition above the threshold amount at which when combined, flocculation and/or precipitation of asphaltenes is triggered. Use of the fatty acids alkyl esters component as described herein allows for a higher amount of such incompatible fuel compositions to be combined with one another without triggering the asphaltenes flocculation and/or precipitation (sludge formation), thereby providing for a fuel composition with improved compatibility.

Accordingly, in general, the present disclosure provides use of a fatty acids alkyl esters component or method to improve or maintain stability and/or compatibility of a residual hydrocarbon component or a residual fuel composition, said use comprising: (a) blending at least 5% m/m to 95% m/m of a residual hydrocarbon component selected from a group consisting of an atmospheric tower bottoms (ATB) residue optionally with a flash point in a range of 80 to 213° C., a vacuum tower bottoms residues (VTB) optionally with a flash point in a range of 220 to 335° C., and any combination thereof with at least 5 m/m to 80% m/m of a fatty acids alkyl esters component, wherein the fatty acids alkyl esters component is blended with the residual hydrocarbon component before another component that decreases the asphaltenes solvency power of the residual hydrocarbon component is added thereto and wherein at least the blending of the fatty acids alkyl esters component before said another component is added increases the asphaltenes stability reserve and/or stability of the residual hydrocarbon component, wherein the increase in stability reserve and/or stability is at least measured by a decrease in the amount of asphaltenes flocculation and/or precipitation in the residual hydrocarbon component or the residual fuel composition relative to the amount of asphaltenes flocculation and/or precipitation in the same residual hydrocarbon component which (i) does not comprise the fatty acids alkyl esters component or (ii) comprises the fatty acids alkyl esters component blended after said another component has been added; or (b) blending at least 5 m/m to 80% m/m of a fatty acids alkyl esters component with a stable residual fuel composition comprising or optionally consisting essentially of (i) at least 5% m/m to 95% m/m of a residual hydrocarbon component selected from a group consisting of an atmospheric tower bottoms (ATB) residue optionally with a flash point in a range of 80 to 213° C., a vacuum tower bottoms residues (VTB) optionally with a flash point in a range of 220 to 335° C., and any combination thereof and (ii) up to 90% m/m of a non-hydroprocessed hydrocarbon component, a hydroprocessed hydrocarbon component, or any combination thereof, wherein the fatty acids alkyl esters component is blended with the stable residual fuel composition before at least one other fuel composition that decreases the asphaltenes solvency power of the residual fuel composition is added thereto and the combination of the stable residual fuel composition and the at least one other fuel composition forms a blended residual fuel composition, and wherein at least the blending of the fatty acids alkyl esters component before the at least one other fuel composition is added increases the compatibility of said stable residual fuel composition and/or the stability of the blended residual fuel composition, wherein the increase in compatibility of the stable residual fuel composition and/or the stability of the blended residual fuel composition is at least measured by a decrease in the amount of asphaltenes flocculation and/or precipitation in the blended residual fuel composition relative to the amount of asphaltenes flocculation and/or precipitation in the same blended residual fuel composition which (i) does not comprise the fatty acids alkyl esters component or (ii) comprises the fatty acids alkyl esters component blended after the at least one other residual marine fuel composition has been added to the stable residual marine fuel composition.

The present disclosure also provides for a fuel composition having improved stability or compatibility comprising or consisting essentially of: at least 5% m/m to 95% m/m of a residual hydrocarbon component selected from a group consisting of an atmospheric tower bottoms (ATB) residue optionally with a flash point in a range of 80 to 213° C., a vacuum tower bottoms residues (VTB) optionally with a flash point in a range of 220 to 335° C., and any combination thereof; at least 5% m/m to 80% m/m of a fatty acids alkyl esters component; and up to 90% m/m of a non-hydroprocessed hydrocarbon component, a hydroprocessed hydrocarbon component, or any combination thereof; wherein the fatty acids alkyl esters component is blended with the residual hydrocarbon component before another component that decreases the asphaltenes solvency power of the residual hydrocarbon component is added thereto.

Components and Properties of the Uses, Methods, and/or Fuel Compositions provided herein:

Residual Hydrocarbon Component

The fuel composition having improved stability may comprise about 5 to 95% m/m of the residual hydrocarbon component. For example, the marine fuel composition may comprise at least 5% m/m, at least 10% m/m, at least 15% m/m, at least 20% m/m, at least 25% m/m, at least 30% m/m, at least 35% m/m, at least 40% m/m, at least 45% m/m, at least 50% m/m, at least 55% m/m, at least 60% m/m, at least 65% m/m, at least 70% m/m, at least 75% m/m, at least 80% m/m, at least 85% m/m, at least 90% m/m and at least 95% m/m, of the residual hydrocarbon component. The marine fuel composition may comprise at most about 95% m/m, for example, at most 90% m/m, at most 85% m/m, at most 80% m/m, at most 75% m/m, at most 70% m/m, at most 65% m/m, at most 60% m/m, at most 55% m/m, at most 50% m/m, at most 45% m/m, at most 40% m/m, at most 35% m/m, at most 30% m/m, at most 25% m/m, at most 20% m/m, at most 15% m/m, at most 10% m/m, or at most 5% m/m of the residual hydrocarbon component.

The residual hydrocarbon component can include any suitable residual hydrocarbon component, including long residues, short residues, or a combination thereof. For instance, residual hydrocarbon components can be residues of distillation processes and may have been obtained as residues in the distillation of crude mineral oil under atmospheric pressure, producing straight run distillate fractions and a first residual oil, which is called "long residue" (or atmospheric tower bottoms (ATB)). The long residue is usually distilled at sub-atmospheric pressure to yield one or more so called "vacuum distillates" and a second residual oil, which is called "short residue" (or vacuum tower bottoms (VTB)).

In particular, the ATB residues are residuals from the atmospheric distillation of crude oil (i.e., the remaining components at the bottom of an atmospheric distillation tower after the atmospheric distillation process of crude oil). The ATB residues generally primarily consists of (e.g., greater than 70% m/m, greater than 80% m/m, or greater than 90% m/m) hydrocarbons having carbon numbers predominantly greater than C20 and boiling above approximately 350° C. (662 degrees F.). Optionally, the ATB residues contain 5% m/m or more of 4- to 6-membered condensed ring aromatic hydrocarbons.

In particular, the VTB residues are residuals from the atmospheric distillation of crude oil (i.e., the remaining components at the bottom of an atmospheric distillation tower after the atmospheric distillation process of crude oil). The VTB residues generally primarily consists of (e.g., greater than 70% m/m, greater than 80% m/m, or greater than 90% m/m) hydrocarbons having carbon numbers predominantly greater than C40 and boiling above approximately 550° C. (1022 degrees F.). Optionally, the VTB residues contain 10% m/m or more of 4- to 6-membered condensed ring aromatic hydrocarbons.

The residual hydrocarbon component may be selected from long residues (ATB), short residues (VTB), and a combination thereof. The long residues (ATB) may exhibit one or more, including all of the following properties: a density at ~15° C. of at most about 1.0 g/cc (or g/cm$^3$), for example, at most 0.95 g/cc, at most 0.90 g/cc, at most 0.85 g/cc, at most 0.80 g/cc, at most 0.75 g/cc, or at most 0.70 g/cc; a density at ~15° C. of at least about 0.70 g/cc, for example, at least 0.75 g/cc, at least 0.80 g/cc, at least 0.85 g/cc, at least 0.90 g/cc, at least 0.95 g/cc, or at least 1.0 g/cc; optionally a sulfur content of about at most 4% m/m, at most 3.5% m/m, at most 3.0% m/m, at most 2.5% m/m, at most 2.0% m/m, at most 1.5% m/m, at most 1.0% m/m, at most 0.5% m/m, at most 0.45% m/m, at most 0.40% m/m, at most 0.35% m/m, at most 0.30% m/m, at most 0.25% m/m, at most 0.20% m/m, at most 0.15% m/m, at most 0.10% m/m, at most 0.05% m/m, or at most 0.01% m/m; a sulfur content of about at least 0.01% m/m, at least 0.05% m/m, at least 0.10% m/m, at least 0.15% m/m, at least 0.20% m/m, at least 0.25% m/m, at least 0.30% m/m, at least 0.35% m/m, at least 0.40% m/m, at least 0.45% m/m, at least 0.50% m/m, at least 1.0% m/m, at least 1.5% m/m, at least 2.0% m/m, at least 2.5% m/m, at least 3.0% m/m, at least 3.5% m/m, or at least 4.0% m/m; a pour point of at least about −20.0° C., such as −19.0° C., for example, at least −15.0° C., at least −10.0° C., at least −5.0° C., at least 0.0° C., at least 5.0° C., at least 10.0° C., at least 15.0° C., at least 20.0° C., at least 25.0° C., at least 30.0° C., at least 35.0° C., at least 40.0° C., at least 45.0° C., at least 50.0° C., at least 55.0° C., or at least 60.0° C., such as 64.0° C., or at least 65.0° C.; a pour point of at most about 65.0° C., such as 64.0° C., for example, at most 60.0° C., at most 55.0° C., at most 50.0° C., at most 45.0° C., at most 40.0° C., at most 35.0° C., at most 30.0° C., at most 25.0° C., at most 20.0° C., at most 15.0° C., at most 10.0° C., at most 5.0° C., at most 0.0° C., at most −5.0° C., at most −10.0° C., at most −15.0° C., such as −19.0° C., or at most −20.0° C.; a flash point of at least about 80° C., for example, at least 85° C., at least 90° C., at least 95° C., at least 100° C., at least 105° C., at least 110° C., at least 115° C., at least 120° C., at least 125° C., at least 130° C., at least 135° C., at least 140° C., at least 145° C., at least 150° C., at least 155° C., at least 160° C., at least 165° C., at least 170° C., at least 175° C., at least 180° C., at least 185° C., at least 190° C., at least 195° C., at least 200° C., at least 205° C., or at least 210° C., such as 213° C.; a flash point of at most about 213° C., for example, at most 210° C., at most 205° C., at most 200° C., at most 195° C., at most 190° C., at most 185° C., at most 180° C., at most 175° C., at most 170° C., at most 165° C., at most 160° C., at most 155° C., at most 150° C., at most 145° C., at most 140° C., at most 135° C., at most 130° C., at most 125° C., at most 120° C., at most 115° C., at most 110° C., at most 105° C., at most 100° C., at most 95° C., at most 90° C., at most 85° C., or at most 80° C.; a total acid number (TAN) of up to about 8.00 mg KOH/g, for example, at most about 7.50 mg KOH/g, at most 7.00 mg KOH/g, at most 6.50 mg KOH/g, at most 6.00 mg KOH/g, at most 5.50 mg KOH/g, at most 5.00 mg KOH/g, at most 4.50 mg KOH/g, at most 4.00 mg KOH/g, at most 3.50 mg KOH/g, at most 3.00 mg KOH/g, at most 2.50 mg KOH/g, at most 2.00 mg KOH/g, at most 1.50 mg KOH/g, at most 1.00 mg KOH/g, at most 0.50 mg KOH/g, at most 0.10 mg KOH/g, or at most 0.05 mg KOH/g; a total acid number (TAN) of at least about 0.05 mg KOH/g, for example, at least 0.10 mg KOH/g, at least 0.50 mg KOH/g, at least 1.00 mg KOH/g, at least 1.50 mg KOH/g, at least 2.00 mg KOH/g, at least 2.50 mg KOH/g, at least 3.00 mg KOH/g, at least 3.50 mg KOH/g, at least 4.00 mg KOH/g, at least 4.50 mg KOH/g, at least 5.00 mg KOH/g, at least 5.50 mg KOH/g, at least 6.00 mg KOH/g, at least 6.50 mg KOH/g, at least 7.00 mg KOH/g, at least 7.50 mg KOH/g, or at least 8.00 mg KOH/g; a kinematic viscosity at ~50° C. of at least about 1.75 cSt, for example, at least 100 cSt, at least 500 cSt, at least 1000 cSt, at least 1500 cSt, at least 2000 cSt, at least 2500 cSt, at least 3000 cSt, at least 3500 cSt, at least 4000 cSt, at least 4500 cSt, at least 5000 cSt, at least 5500 cSt, at least 6000 cSt, at least 6500 cSt, at least 7000 cSt, at least 7500 cSt, at least 8000 cSt, at least 8500 cSt, at least 9000 cSt, at least 9500 cSt, at least 10000 cSt, at least 10500 cSt, at least 11000 cSt, at least 11500 cSt, at least 12000 cSt, at least 12500 cSt, at least 13000 cSt, at least 13500 cSt, at least 14000 cSt, at least 14500 cSt, or at least 15000 cSt; a kinematic viscosity at ~50° C. of at most about 15000 cSt, for example, at most 14500 cSt, at most 14000 cSt, at most 13500 cSt, at most 13000 cSt, at most 12500 cSt, at most 12000 cSt, at most 11500 cSt, at most 11000 cSt, at most 10500 cSt, at most 10000 cSt, at most 9500 cSt, at most 9000 cSt, at most 8500 cSt, at most 8000 cSt, at most 7500 cSt, at most 7000 cSt, at most 6500 cSt, at most 6000 cSt, at most 5500 cSt, at most 5000 cSt, at most 4500 cSt, at most 4000 cSt, at most 3500 cSt, at most 3000 cSt, at most 2500 cSt, at most 2000 cSt, at most 1500 cSt, at most 1000 cSt, at most 500 cSt, at most 100 cSt, or at most 1.75 cSt.

The short or VTB residues may exhibit one or more, including all of the following properties: a density at ~15° C. of at most about 1.2 g/cc, for example, at most 1.05 g/cc, at most 1.00 g/cc, at most 0.95 g/cc, at most 0.90 g/cc, at most 0.85 g/cc, or at most 0.70 g/cc; a density at ~15° C. of at least about 0.70 g/cc, for example, at least 0.75 g/cc, at least 0.80 g/cc, at least 0.85 g/cc, at least 0.90 g/cc, at least 0.95 g/cc, at least 1.0 g/cc, at least 1.05 g/cc, at least 1.1 g/cc, at least 1.15 g/cc, or at least 1.20 g/cc; a pour point in a range of at least ~15.0° C., for example, at least ~15.0° C., at least ~10° C., at least ~5° C., at least 0.0° C., at least 5.0° C., at least 10.0° C., at least 15.0° C., at least 20.0° C., at least 25.0° C., at least 30.0° C., at least 35.0° C., at least 40.0° C., at least 45.0° C., at least 50.0° C., at least 55.0° C., at least 60.0° C., at least 65.0° C., at least 70.0° C., at least 75.0° C., at least 80.0° C., at least 85.0° C., at least 90.0° C., or at least 95.0° C.; a pour point of at most about 95.0° C., for example, at most 90.0° C., at most 85.0° C., at most 80.0° C., at most 75.0° C., at most 70.0° C., at most 65.0° C., at most 60.0° C., at most 55.0° C., at most 50.0° C., at most 45.0° C., at most 40.0° C., at most 35.0° C., at most 30.0° C., at most 25.0° C., at most 20.0° C., at most 15.0° C., at most 10.0° C., at most 5.0° C., at most 0.0° C., at most −5.0° C., at most −10° C., at most −15.0° C.; a flash point of at least about 220° C., for example, at least 225° C., at least 230° C., at least 235° C., at least 240° C., at least 245° C., at least 250° C., at least 255° C., at least 260° C., at least 265° C., at least 270° C., at least 275° C., at least 280° C., at least 285° C., at least 290° C., at least 295° C., at least 300° C., at least 305° C., at least 310° C., at least 315° C., at least 320° C., at least 325° C., at least 330° C., or at least 335° C.; a flash point of at most about 335° C., for example, at most 330° C., at most 325° C., at most 320° C., at most 315° C., at most 310° C., at most 305° C., at most 300° C., at most 295° C., at most 290° C., at most 285° C., at most 280° C., at most 275° C., at most 270° C., at most 265° C., at most 260° C., at most 255° C., at most 250° C., at most 245° C., at most 240° C., at most 235° C., at most 230° C., at most 225° C., or at most 220° C.; a total acid number (TAN) of up to about 8.00 mg KOH/g, for example, at most about 7.50 mg KOH/g, at most 7.00 mg KOH/g, at most about 6.50 mg KOH/g, at most 6.00 mg KOH/g, at most 5.50 mg KOH/g, at most 5.00 mg KOH/g, at most 4.50 mgKOH/g, at most 4.00 mgKOH/g, at most 3.50 mgKOH/g, at most 3.00 mgKOH/g, at most 2.50 mgKOH/g, at most 2.00 mgKOH/g, at most 1.50 mgKOH/g, at most 1.00 mgKOH/g, at most 0.50 mgKOH/g, at most 0.10 mgKOH/g, or at most 0.05 mgKOH/g; a total acid number (TAN) of at least about 0.05 mgKOH/g, for example, at least 0.10 mgKOH/g, at least 0.50 mgKOH/g, at least 1.00 mgKOH/g, at least 1.50 mgKOH/g, at least 2.00 mgKOH/g, at least 2.50 mgKOH/g, at least 3.00 mgKOH/g, at least 3.50 mgKOH/g, at least 4.00 mgKOH/g, at least 4.50 mgKOH/g, at least 5.00 mgKOH/g, at least 5.50 mgKOH/g, at least 6.00 mgKOH/g, at least 6.50 mgKOH/g, at least 7.00 mgKOH/g, at least 7.50 mgKOH/g, or at least 8.00 mgKOH/g; a kinematic viscosity at ~50° C. of at least about 3.75 cSt, for example, at least 100 cSt, at least 500 cSt, at least 1000 cSt, at least 1500 cSt, at least 2000 cSt, at least 2500 cSt, at least 3000 cSt, at least 3500 cSt, at least 4000 cSt, at least 4500 cSt, at least 5000 cSt, at least 5500 cSt, at least 6000 cSt, at least 6500 cSt, at least 7000 cSt, at least 7500 cSt, at least 8000 cSt, at least 8500 cSt, at least 9000 cSt, at least 9500 cSt, at least 10000 cSt, at least 10500 cSt, at least 11000 cSt, at least 11500 cSt, at least 12000 cSt, at least 12500 cSt, at least 13000 cSt, at least 13500 cSt, at least 14000 cSt, at least 14500 cSt, or at most 15000 cSt; a kinematic viscosity at ~50° C. of at most about 15000 cSt, for example, at most 14500 cSt, at most 14000 cSt, at most 13500 cSt, at most 13000 cSt, at most 12500 cSt, at most 12000 cSt, at most 11500 cSt, at most 11000 cSt, at most 10500 cSt, at most 10000 cSt, at most 9500 cSt, at most 9000 cSt, at most 8500 cSt, at most 8000 cSt, at most 7500 cSt, at most 7000 cSt, at most 6500 cSt, at most 6000 cSt, at most 5500 cSt, at most 5000 cSt, at most 4500 cSt, at most 4000 cSt, at most 3500 cSt, at most 3000 cSt, at most 2500 cSt, at most 2000 cSt, at most 1500 cSt, at most 1000 cSt, at most 500 cSt, or at most 3.75 cSt. The characteristics can be determined using any suitable standardized test method, such as ASTM D445 for viscosity, ASTM D4294 for sulfur content, ASTM D9 for flash point, and ASTM D97 for pour point. Additionally or alternatively, the VTB residues can further have a sulfur content of about at most 4% m/m, at most 3.5% m/m, at most 3.0% m/m, at most 2.5% m/m, at most 2.0% m/m, at most 1.5% m/m, at most 1.0% m/m, at most 0.5% m/m, at most 0.45% m/m, at most 0.40% m/m, at most 0.35% m/m, at most 0.30% m/m, at most 0.25% m/m, at most 0.20% m/m, at most 0.15% m/m, at most 0.10% m/m, at most 0.05% m/m, or at most 0.01% m/m; a sulfur content of about at least 0.01% m/m, at least 0.05% m/m, at least 0.10% m/m, at least 0.15% m/m, at least 0.20% m/m, at least 0.25% m/m, at least 0.30% m/m, at least 0.35% m/m, at least 0.40% m/m, at least 0.45% m/m, at least 0.50% m/m, at least 1.0% m/m, at least 1.5% m/m, at least 2.0% m/m, at least 2.5% m/m, at least 3.0% m/m, at least 3.5% m/m, or at least 4.0% m/m;

In a particular embodiment, the residual hydrocarbon component may be selected from a group consisting of long residues (ATB), short residues (VTB), and a combination thereof, where the ATB residues may exhibit one or more, including all of the following characteristics: a density at ~15° C. in a range of about 0.7 to 1.0 g/cc; a pour point in a range of about −19.0 to 65.0° C.; a flash point in a range of about 80 to 213° C.; a total acid number (TAN) of up to about 8.00 mgKOH/g; and a kinematic viscosity at ~50° C. in a range of about 1.75 to 15000 cSt; and where the short residues (VTB) may exhibit one or more, including all of the following properties: a density at ~15° C. in a range of about 0.7 to 1.2 g/cc; a pour point in a range of about −15.0 to 95° C.; a flash point in a range of about 220 to 335° C.; a total acid number (TAN) of up to about 8.00 mgKOH/g; and a kinematic viscosity at ~50° C. in a range of about 3.75 to 15000 cSt. It is understood that there can be different kinds of long and short residues that exhibit various properties as described above that may be similar or different to each other. One or more kinds of long and/or short (ATB and/or VTB) residues exhibiting one or more characteristics provided above may be used to provide the residual hydrocarbon component in the desired amount, e.g., in a range of 5 to 95% m/m of the overall marine fuel composition.

Non-Hydroprocessed and/or Hydroprocessed Hydrocarbon Component

The fuel composition having improved stability can comprise up to 90% m/m of one or more hydrocarbon components other than the residual hydrocarbon component, where the one or more hydrocarbon components is selected from a non-hydroprocessed hydrocarbon component, a hydroprocessed hydrocarbon component, and a combination thereof. For instance, the marine fuel composition can comprise a non-hydroprocessed hydrocarbon component in an amount of up to 90% m/m. The marine fuel composition may comprise the non-hydroprocessed hydrocarbon component in an amount of at most 90% m/m, at most 85% m/m, at most 80% m/m, at most 75% m/m, at most 70% m/m, at most 65% m/m, at most 60% m/m, at most 55% m/m, at most 50% m/m, at most 45% m/m, at most 40% m/m, at most 35% m/m, at most 30% m/m, at most 25% m/m, at most 20% m/m, at most 15% m/m, at most 10% m/m, at most 5% m/m, or none.

In some embodiments, the non-hydroprocessed hydrocarbon includes hydrocarbon products derived from oil cuts or cuts of a petrochemical origin which have not been subjected to hydrotreatment or hydroprocessing (HT). Non-limiting examples of hydrotreatment or hydroprocessing includes hydrocracking, hydrodeoxygenation, hydrodesulphurization, hydrodenitrogenation and/or hydroisomerization. In a particular embodiment, the non-hydroprocessed hydrocarbon component is selected from the group consisting of light cycle oil (LCO), heavy cycle oil (HCO), fluid catalytic cracking (FCC) cycle oil, FCC slurry oil, pyrolysis gas oil, cracked light gas oil (CLGO), cracked heavy gas oil (CHGO), pyrolysis light gas oil (PLGO), pyrolysis heavy gas oil (PHGO), pyrolysis residue (ECR), thermally cracked residue (also called tar or thermal tar), thermally cracked heavy distillate, coker heavy distillates, which is heavier than diesel, and any combination thereof. In other embodiments, in addition to or alternatively, the non-hydroprocessed hydrocarbon component is selected from the group consisting of vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), and any combination thereof. In yet another embodiment, in addition to or alternatively, the non-hydroprocessed hydrocarbon component is selected from the group consisting of coker kerosene, thermally cracked kerosene, gas-to-liquids (GTL) wax, GTL hydrocarbons, straight-run diesel, straight-run kerosene, straight run gas oil (SRGO), and any combination thereof. While preferred, a non-hydroprocessed hydrocarbon component is not required in a marine fuel composition described herein, particularly when a residual hydrocarbon component and a hydroprocessed hydrocarbon component can provide the marine fuel composition with the requisite or desired properties. Also, one or more kinds of non-hydroprocessed hydrocarbon component may be used to provide the marine fuel composition with the desired characteristics.

The materials listed above have their ordinary meaning as understood by one of ordinary skill in the art. For example, LCO is herein preferably refers to a fraction of fluid catalytic cracking (FCC) products of which at least 80% m/m, more preferably at least 90% m/m, boils in the range from equal to or more than 221° C. to less than 370° C. (at a pressure of 0.1 Megapascal). HCO is herein preferably refers to a fraction of the FCC products of which at least 80% m/m, more preferably at least 90% m/m, boils in the range from equal to or more than 370° C. to less 425° C. (at a pressure of 0.1 Megapascal). Slurry oil is herein preferably refers to a fraction of the FCC products of which at least 80% m/m, more preferably at least 90% m/m, boils at or above 425° C. (at a pressure of 0.1 Megapascal).

Additionally, or alternatively, the marine fuel composition can comprise a hydroprocessed hydrocarbon component. For example, the marine fuel composition may comprise the hydroprocessed hydrocarbon component in an amount of up to 90% m/m. The marine fuel composition may comprise the hydroprocessed hydrocarbon component in an amount of at most 90% m/m, at most 85% m/m, at most 80% m/m, at most 75% m/m, at most 70% m/m, at most 65% m/m, at most 60% m/m, at most 55% m/m, at most 50% m/m, at most 45% m/m, at most 40% m/m, at most 35% m/m, at most 30% m/m, at most 25% m/m, at most 20% m/m, at most 15% m/m, at most 10% m/m, at most 5% m/m, or none. The hydroprocessed hydrocarbon component can be derived from oil cuts or cuts of a petrochemical origin which have been subjected to hydrotreatment or hydroprocessing, which can be referred to as hydrotreated. Non-limiting examples of hydrotreatment or hydroprocessing includes hydrocracking, hydrodeoxygenation, hydrodesulphurization, hydrodenitrogenation and/or hydroisomerization.

In a particular embodiment, the hydroprocessed hydrocarbon component can comprise at least one of low-sulfur diesel (LSD) of less than about 500 ppmw of sulfur, particularly ultra low-sulfur diesel (ULSD) of less than 15 or 10 ppmw of sulfur; hydrotreated LCO; hydrotreated HCO; hydrotreated FCC cycle oil; hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate. In another embodiment, in addition to or alternatively, the hydroprocessed hydrocarbon component can comprise at least one of hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms (which can also be known as hydrocracker hydrowax), hydrotreated thermally cracked VGO, and hydrotreated hydrocracker DAO. In yet another embodiment, in addition to or alternatively, the hydroprocessed hydrocarbon component can comprise at least one of ultra low sulfur kerosene (ULSK), hydrotreated jet fuel, hydrotreated kerosene, hydrotreated coker kerosene, hydrocracker diesel, hydrocracker kerosene, hydrotreated thermally cracked kerosene. While preferred, a hydroprocessed hydrocarbon component is not required in a marine fuel composition described herein, particularly when a residual hydrocarbon component and a non-hydroprocessed hydrocarbon component can provide the marine fuel composition with the requisite or desired properties. Also, one or more kinds of hydroprocessed hydrocarbon component may be used to provide the marine fuel composition with the desired characteristics.

Fatty Acids Alkyl Esters Component

The fuel composition having improved stability may comprise about 5 to 80% m/m of the fatty acids alkyl esters component. For example, the fuel composition may comprise at least 5% m/m, at least 10% m/m, at least 15% m/m, at least 20% m/m, at least 25% m/m, at least 30% m/m, at least 35% m/m, at least 40% m/m, at least 45% m/m, at least 50% m/m, at least 55% m/m, at least 60% m/m, at least 65% m/m, at least 70% m/m, at least 75% m/m, or at least 80% m/m of the fatty acids alkyl esters component. The fuel composition may comprise at most about 80% m/m, for example, at most 80% m/m, at most 75% m/m, at most 70% m/m, at most 65% m/m, at most 60% m/m, at most 55% m/m, at most 50% m/m, at most 45% m/m, at most 40% m/m, at most 35% m/m, at most 30% m/m, at most 25% m/m, at most 20% m/m, at most 15% m/m, or at most 10% m/m, or at most 5% m/m of the fatty acids alkyl esters component.

Fatty acid alkyl esters may also be known as biodiesel. Fatty acid alkyl esters are commonly produced by the reaction of various vegetable oils and/or animal fats with alcohols in the presence of a suitable catalyst. The reaction of the oils with an alcohol to produce a fatty acid ester and glycerin is commonly referred to as transesterification. Alternatively, fatty acids alkyl esters can be produced by the reaction of a fatty acid with an alcohol (commonly referred to as esterification) to form the fatty acid ester.

The fatty acid segments of triglycerides are typically composed of $C_{10}$-$C_{24}$ fatty acids, where the fatty acid composition can be uniform or a mixture of various chain lengths. Suitable oil(s) and/or fat(s) may be selected from the group consisting of Soy, Palm, Rapeseed, Linseed, Coconut, Corn, Cotton, Algae, Cooking, Sunflower, Safflower, Sesame, Castor, Tallow, Lard, Yellow Grease, Brown Grease, Fish Oils, Used Cooking Oils, Waste Cooking Oils and any combination thereof.

Suitable alcohols used in either of the esterification processes can be aliphatic or aromatic, saturated or unsaturated, branched or linear, primary, secondary or tertiary, and may possess any hydrocarbon chain having lengths from about one to twenty two carbon atoms (C-1 to about C-22). The industry and typical choices being identified as methanol and ethanol.

The fatty acid alkyl esters may meet certain specification parameters set forth for biodiesel, such as the ASTM D6751 and/or EN 14214, the entire teaching of which is incorporated herein by reference. The ASTM D6751 and EN 14214 specification outlines the requirements for biodiesel (B100) to be considered as a suitable blending stock for hydrocarbon fuels.

Optional Additives

Additionally, or alternately, in certain embodiments, the marine fuel composition can comprise other components aside from components (i) the residual hydrocarbon, (ii) fatty acids alkyl ester, and optionally (iii) the hydroprocessed hydrocarbon, and/or (iv) the non-hydroprocessed hydrocarbon. Such other components may typically be present in the fuel composition as fuel additives. Examples of such other components can include, but are not limited to, detergents, viscosity modifiers, pour point depressants, lubricity modifiers, dehazers, e.g. alkoxylated phenol formaldehyde polymers; anti-foaming agents (e.g., polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; deodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; combustion improvers; and mixtures thereof.

Examples of detergents suitable for use in fuel additives include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808.

In one embodiment, if present, a lubricity modifier enhancer may be conveniently used at a concentration of less than 1000 ppmw, preferably from 50 to 1000 or from 100 to 1000 ppmw, more preferably from 50 to 500 ppmw. Suitable commercially available lubricity enhancers include ester- and acid-based additives. It may also be preferred for the fuel composition to contain an anti-foaming agent, more preferably in combination with an anti-rust agent and/or a corrosion inhibitor and/or a lubricity modifying additive. Unless otherwise stated, the concentration of each such additional component in the fuel composition is preferably up to 10000 ppmw, more preferably in the range from 0.1 to 1000 ppmw, advantageously from 0.1 to 300 ppmw, such as from 0.1 to 150 ppmw (all additive concentrations quoted in this specification refer, unless otherwise stated, to active matter concentrations by weight). The concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The concentration of any ignition improver present will preferably be 2600 ppmw or less, more preferably 2000 ppmw or less, conveniently from 300 to 1500 ppmw.

If desired, one or more additive components, such as those listed above, may be co-mixed-preferably together with suitable diluent(s)—in an additive concentrate, and the additive concentrate may then be dispersed into the base fuel, or into the base fuel/wax blend, in order to prepare a fuel composition according to the present invention.

Properties of the Fuel Composition

The fuel composition preferably has a micro carbon residue of greater than 0.30% m/m, as measured by a suitable standard method known to one of ordinary skill in the art, such as ASTM D4530 or ISO 10370. In particular, the marine fuel has a micro carbon residue of at least 0.50% m/m, at least 1.00% m/m, at least 1.50% m/m, at least 2.00% m/m, at least 2.50% m/m, at least 3.00% m/m, at least 3.50% m/m, at least 4.00% m/m, at least 4.50% m/m, at least 5.00% m/m, at least 5.50% m/m, at least 6.00% m/m, at least 6.50% m/m, at least 7.00% m/m, at least 7.50% m/m, at least 8.00% m/m, at least 8.50% m/m, at least 9.00% m/m, at least 9.50% m/m, at least 10.00% m/m, at least 10.50% m/m, at least 11.00% m/m, at least 11.50% m/m, at least 12.00% m/m, at least 12.50% m/m, at least 13.00% m/m, at least 13.50% m/m, at least 14.00% m/m, at least 14.50% m/m, at least 15.00% m/m, at least 15.50% m/m, at least 16.00% m/m, at least 16.50% m/m, at least 17.00% m/m, at least 17.50% m/m, at least 18.00% m/m, at least 18.50% m/m, at least 19.00% m/m, at least 19.50% m/m, or at least 20.00% m/m. In another instance, the marine fuel has a micro carbon residue of at most 0.30% m/m, at most 0.50% m/m, 2.50% m/m, at most 1.00% m/m, at most 1.50% m/m, at most 2.00% m/m, at most 2.50% m/m, at most 3.00% m/m, at most 3.50% m/m, at most 4.00% m/m, at most 4.50% m/m, at most 5.00% m/m, at most 5.50% m/m, at most 6.00% m/m, at most 6.50% m/m, at most 7.00% m/m, at most 7.50% m/m, at most 8.00% m/m, at most 8.50% m/m, at most 9.00% m/m, at most 9.50% m/m, at most 10.00% m/m, at most 10.50% m/m, at most 11.00% m/m, at most 11.50% m/m, at most 12.00% m/m, at most 12.50% m/m, at most 13.00% m/m, at most 13.50% m/m, at most 14.00% m/m, at most 14.50% m/m, at most 15.00% m/m, at most 15.50% m/m, at most 16.00% m/m, at most 16.50% m/m, at most 17.00% m/m, at most 17.50% m/m, at most 18.00% m/m, at most 18.50% m/m, at most 19.00% m/m, at most 19.50% m/m, or at most 20.00% m/m. Preferably, the marine fuel can have a micro carbon number in a range of greater than 0.30% m/m and 20.00% m/m, particularly any amount or range in between as specified here or otherwise.

Carbon residue tests, such as the Micro Carbon Residue (MCR) Test (ASTM D4530) or the ASTM D189 test for Conradson Carbon Residue (CCR), are primarily used on residual fuels since the distillate fuels that are satisfactory in other respects do not have high amounts of carbon residue. It is understood that the MCR and CCR tests are also used for distillate fuels to confirm that they contain an acceptable amount of carbon residue content below a specified level. This is reflected in the ISO 8217 limiting the amount of micro carbon residue to a maximum of 0.30% m/m for marine distillate fuels. Because of the difference in the MCR and CCR results between distillate and residual fuels, the MCR and CCR tests can be used as an indication of contamination of distillate fuel by residual fuel.

The fuel composition can have a sulfur content of about 0.08% m/m to about 3.5% m/m, for example about 0.1% m/m to about 3.5% m/m, for example about 0.3% m/m to about 3.5% m/m, about 0.5% m/m to about 3.5% m/m, about 1.0% m/m to about 3.5% m/m, about 1.5% m/m to about 3.5% m/m, about 2.0% m/m to about 3.5% m/m, about 0.1% m/m to about 3.0% m/m, about 0.3% m/m to about 3.0% m/m, about 0.5% m/m to about 3.0% m/m, about 1.0% m/m to about 3.0% m/m, about 1.5% m/m to about 3.0% m/m, about 2.0% m/m to about 3.0% m/m, about 0.1% m/m to about 2.5% m/m, about 0.3% m/m to about 2.5% m/m, about 0.5% m/m to about 2.5% m/m, about 1.0% m/m to about 2.5% m/m, or about 1.5% m/m to about 2.5% m/m. There can be various tiers of "low" sulfur for the fuel composition, with the lowest sulfur tier being content of about 0.0001% m/m (~1 ppmw) to about 0.05% m/m 0500 ppmw), for example about 0.0001% m/m to about 0.03% m/m, about 0.001% m/m to about 0.05% m/m, about 0.001% m/m to about 0.03% m/m, about 0.005% m/m to about 0.05% m/m, about 0.005% m/m to about 0.03% m/m, about 0.01% m/m to about 0.05% m/m, or about 0.01% m/m to about 0.03% m/m. The next sulfur content tier can be about 0.01% m/m (~100 ppmw) to about 0.1% m/m (~1000 ppmw), for example about 0.01% m/m to about 0.05% m/m, about 0.02% m/m to about 0.1% m/m, about 0.02% m/m to about 0.05% m/m, or about 0.05% m/m to about 0.1% m/m. The next tier can be a sulfur content of about 0.05% m/m (~500 ppmw) to about 0.5% m/m (~5000 ppmw), for example about 0.1% m/m to about 0.5% m/m, about 0.05% m/m to about 0.3% m/m, or about 0.1% m/m to about 0.3% m/m.

It is understood that the sulfur content of the residual hydrocarbon component, the non-hydroprocessed hydrocarbon component, and/or the hydroprocessed hydrocarbon component, individually, can vary, as long as the marine fuel composition as a whole meets the sulfur target content requirement for a certain embodiment. Likewise, in one embodiment, it is understood that other characteristics of the residual hydrocarbon component, the non-hydroprocessed hydrocarbon component, and/or the hydroprocessed hydrocarbon component, individually, can vary, as long as the marine fuel composition meets the requirements of a standardization, such as ISO 8217. As such, certain embodiments can allow for greater use of cracked materials, for example, 25% m/m or greater.

Still further additionally or alternately, in some embodiments, the marine fuel composition can exhibit one or more, including all of the following characteristics: a kinematic viscosity at about 50° C. (according to a suitable standardized test method, e.g., ASTM D445) of at most about 700 cSt, for example at most 500 cSt, at most 380 cSt, at most 180 cSt, at most 80 cSt, at most 55 cSt, at most 50 cSt, at most 45 cSt, at most 40 cSt, at most 35 cSt, at most 30 cSt, at most 25 cSt, at most 20 cSt, at most 15 cSt, at most 10 cSt, or at most 5 cSt; for example, about 4, 5, 6, 7, 8, 9, 10, 11, 12, 13, 14, 15, 16, 17, 18, 19, 20, or 21 cSt; a kinematic viscosity at about 50° C. (according to a suitable standardized test method, e.g., ASTM D445) of at least 5 cSt, for example at least 10 cSt, at least 15 cSt, at least 20 cSt, at least 25 cSt, at least 30 cSt, at least 35 cSt, at least 40 cSt, at least 45 cSt; at least 50 cSt, at least 55 cSt, at least 80 cSt, at least 180 cSt, at least 380 cSt, at least 500 cSt, or at least 700 cSt; a density at about 15° C. (according to a suitable standardized test method, e.g., ASTM D4052) of at most 1.010 g/cm$^3$, for example, at most 1.005, at most 1.000, at most 0.995, such as 0.991 g/cm$^3$, at most 0.990 g/cm$^3$, at most 0.985 g/cm$^3$, at most 0.980 g/cm$^3$, at most 0.975 g/cm$^3$, at most 0.970 g/cm$^3$, at most 0.965 g/cm$^3$, at most 0.960 g/cm$^3$, at most 0.955 g/cm$^3$, at most 0.950 g/cm$^3$, at most 0.945 g/cm$^3$, at most 0.940 g/cm$^3$, at most 0.935 g/cm$^3$, at most 0.930 g/cm$^3$, at most 0.925 g/cm$^3$, at most 0.920 g/cm$^3$, at most 0.915 g/cm$^3$, at most 0.910 g/cm$^3$, at most 0.905 g/cm$^3$, at most 0.900 g/cm$^3$, at most 0.895 g/cm$^3$, at most 0.890 g/cm$^3$, at most 0.885 g/cm$^3$, or at most 0.880 g/cm$^3$; a density at about 15° C. (according to a suitable standardized test method, e.g., ASTM D4052) of at least 0.870 g/cm$^3$, at least 0.875 g/cm$^3$, at least 0.880 g/cm, at least 0.885 g/cm$^3$, at least 0.890 g/cm$^3$, at least 0.895 g/cm$^3$, at least 0.900 g/cm$^3$, at least 0.905 g/cm$^3$, at least 0.910 g/cm$^3$, at least 0.915 g/cm$^3$, at least 0.920 g/cm$^3$, at least 0.925 g/cm$^3$, at least 0.930 g/cm$^3$, at least 0.935 g/cm$^3$, at least 0.940 g/cm$^3$, at least 0.945 g/cm$^3$, at least 0.950 g/cm$^3$, at least 0.955 g/cm$^3$, at least 0.960 g/cm$^3$, at least 0.965 g/cm$^3$, at least 0.970 g/cm$^3$, at least 0.975 g/cm$^3$, at least 0.980 g/cm$^3$, at least 0.985 g/cm$^3$, at least 0.990 g/cm$^3$, such as 0.991 g/cm$^3$, at least 0.995 g/cm$^3$, at least 1.000 g/cm$^3$, at least 1.005 g/cm$^3$, or at least 1.010 g/cm$^3$; a pour point (according to a suitable standardized test method, e.g., ASTM D97) of at most 35° C., at most 30° C., for example, at most 28° C., at most 25° C., at most 20° C., at most 15° C., at most 10° C., for example 6° C., at most 5° C., at most 0° C., at most −5° C., at most −10° C., at most −15° C., at most −20° C., at most −25° C., such as −27° C., or at most −30° C.; a pour point (according to a suitable standardized test method, e.g., ASTM D97) of at least −30° C., such as −27° C., for example, at least −25° C., at least −20° C., at least −15° C., at least −10° C., at least −5° C., at least 0° C., at least 5° C., at least 7° C., at least 10° C., at least 15° C., at least 20° C., at least 25° C., at least 30° C., or at least 35° C., and a flash point (according to a suitable standardized testing method, e.g., ASTM D93 Proc. 9 (Automatic)) of at least about 60° C., for example, at least 65° C., at least 70° C., at least 75° C., at least 80° C., at least 85° C., at least 90° C., at least 95° C., at least 100° C., at least 105° C., at least 110° C., at least 115° C., at least 120° C., at least 125° C., or at least 130° C.; an acid number (also known as Total Acid Number or TAN) of at most 2.5 mgKOH/g, for example, at most 2.0 mgKOH/g, at most 1.5 mgKOH/g, at most 1.0 mgKOH/g, or at most 0.5 mgKOH/g; an acid number of at least 0.5 mgKOH/g, at least 1.0 mgKOH/g, at least 1.5 mgKOH/g, at least 2.0 mgKOH/g, or at least 2.5 mgKOH/g.

In one embodiment, the marine fuel composition may exhibit one or more, including all of the following characteristics: a kinematic viscosity at about 50° C. (according to a suitable standardized test method, e.g., ASTM D445) in a range of about 5 to 700 cSt, for example, at most 700.0 cSt, at most 500.0 cSt, at most 380.0 cSt, at most 180.0 cSt, at most 80.00 cSt, at most 30.00 cSt, or at most 10.00 cSt; a density at about 15° C. (according to a suitable standardized test method, e.g., ASTM D4052) in a range of about 0.870 to 1.010 g/cm$^3$, for example, at most 0.920 g/cm$^3$, at most 0.960 g/cm$^3$, at most 0.975 g/cm$^3$, at most 0.991 g/cm$^3$, or at most 1.010 g/cm$^3$, particularly, at least 0.890 g/cm$^3$; a pour point (according to a suitable standardized test method, e.g., ASTM D97) in a range of about −30 to 35° C., such as −27 to 30° C., for example, at most 6 to 30° C. or at most 0 to 30° C.; a flash point (according to a suitable standardized testing method, e.g., ASTM D93 Proc. 9 (Automatic)) in a range of about 60 to 130° C., for example, at least 60° C.; an acid number in a range of about 0.0 to 2.5 mgKOH/g, for example, at most about 2.5 mgKOH/g.

Yet still further additionally or alternately, the marine and/or bunker fuels, e.g., made according to the methods disclosed herein, can exhibit at least one or more, including all of the following characteristics: a hydrogen sulfide content (according to a suitable standardized test method, e.g., IP 570) of at most about 2.0 mg/kg; an acid number (according to a suitable standardized test method, e.g., ASTM D-664) of at most about 2.5 mg KOH per gram; a sediment content (according to a suitable standardized test method, e.g., ASTM D4870 Proc. B) of at most about 0.1% m/m; a water content (according to a suitable standardized test method, e.g., ASTM D95) of at most about 0.5% v/v, for example about 0.3% v/v; and an ash content (according to a suitable standardized testing method, e.g., ASTM D482) of at most about 0.15% m/m, for example, about 0.10% m/m, 0.07% m/m, or 0.04% m/m.

To facilitate a better understanding of the present invention, the following examples of preferred or representative embodiments are given. In no way should the following examples be read to limit, or to define, the scope of the invention.

EXAMPLES

The following are non-limiting Examples of exemplary embodiments of the marine fuel composition described herein.

Example 1

Referring to FIG. 1, a sample of an unstable VTB residual hydrocarbon component was observed under a microscopic magnification of 100×. The VTB residual hydrocarbon component has a density of 0.9092 kg/1, a kinematic viscosity @ 50° C. of 519 cSt, a sulphur content of 0.08% m/m, and a pour point of 42.2° C. FIG. 1 shows a "rough" texture with darker regions spread throughout, giving an appearance of unevenness or roughness, which indicates the VTB residual hydrocarbon component contains flocculated and precipitated asphaltenes (darker regions). Asphaltene flocculation is generally known in the art as when the asphaltenes begin to aggregate with one another until the aggregations reach a certain threshold that they precipitate out of solution. The VTB residual hydrocarbon component may be considered as "unstable" due to the observable amount of flocculated asphaltenes.

This unstable VTB residual hydrocarbon component sample was blended with a fatty acids alkyl esters produced by transesterification of used cooking oils or "used cooking oil methyl esters" (UCOME). The fatty acids alkyl esters component had a density of 0.879 kg/1, kinematic viscosity @ 50° C. of 4.361 cSt, and flash point of 158.5° C. The VTB residual hydrocarbon component and the UCOME were blended in 1:1 (by volume) ratio and stirred for 30 minutes at 100° C.

Figure 2:
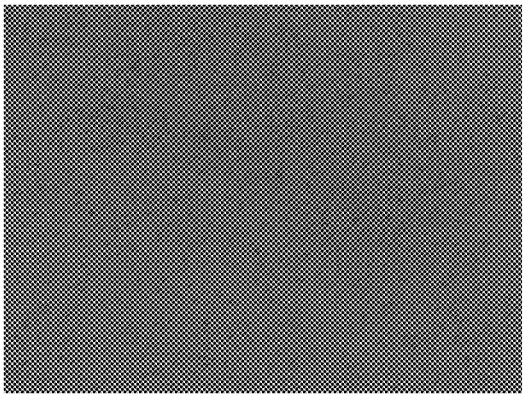
FIG. 2 shows the VTB residual hydrocarbon component from FIG. 1 with a fatty acids alkyl esters component added, which is observed under microscopic magnification of 100×.
Figure 3:
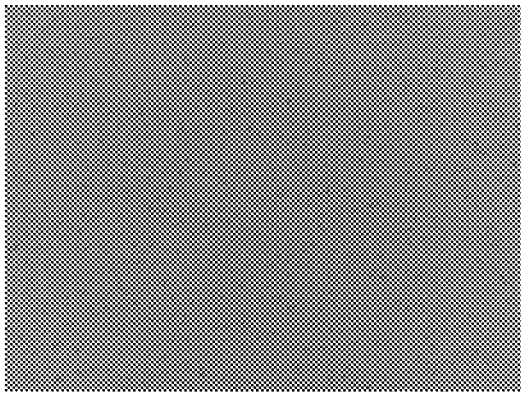
FIG. 3 shows the VTB residual hydrocarbon component from FIG. 2 after three days of storage, which is observed under microscopic magnification of 100×.
Figure 4:
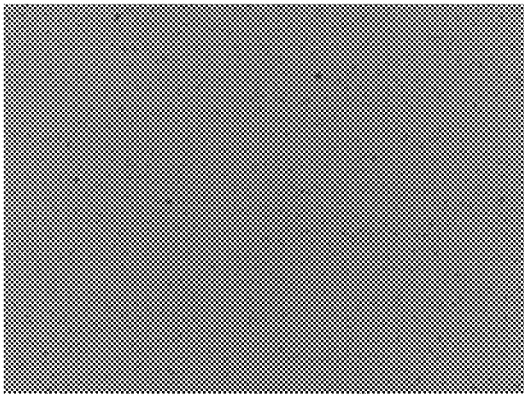
FIG. 4 shows the VTB residual hydrocarbon component from FIG. 2 after four weeks of storage, which is observed under microscopic magnification of 100×.

Referring to FIG. 2, the resulting blend was observed under the same microscopic magnification of 100×. FIG. 2 shows a "smoother" texture as compared to FIG. 1 with fewer darker regions spread throughout which indicates a reduction in the amount of flocculated ("rough" texture regions) and precipitated asphaltenes (black fragments) as compared to the VTB residual hydrocarbon component without the UCOME seen in FIG. 1. The reduction in the amount of flocculated and precipitated asphaltenes as seen under microscopic observation indicates that the asphaltenes are dissolved to a greater level in the presence of the UCOME (FIG. 2) as compared to without the UCOME (FIG. 1), thereby resulting in improved stability and potentially compatibility of the residual hydrocarbon component. Asphaltenes solubility in the blend during storage was also observed. Referring to FIGS. 3 and 4, the blend of the VTB residual hydrocarbon component and UCOME of FIG. 2 was observed again under the same microscopic magnification after 3 days (FIG. 3) and after 4 weeks (FIG. 4). As can be seen, both FIGS. 3 and 4 show similar "smoothness" as FIG. 2 and do not show any increase in the darker regions similar to FIG. 1, which indicates the asphaltenes did not re-flocculate and re-precipitate even after the blend was stored for a month, which indicates the stabilizing effect of the fatty acids alkyl esters remains even after storage of the fuel for a month.

The increase in stability reserve and/or stability of the residual hydrocarbon component through at least use of the fatty acid alkyl ester can at least be measured by a decrease in the amount of asphaltenes flocculation and/or precipitation in the residual hydrocarbon component (FIGS. 2-4) when compared to the amount of asphaltenes flocculation and/or precipitation in the same residual fuel component except that it does not comprise the fatty acids alkyl esters component (FIG. 1). The decrease in the amount of asphaltenes flocculation and/or precipitation can be measured or determined at least through observation under a microscope, such as under 100× magnification here or by any other suitable methods known to one of ordinary skill, such as those mentioned in this disclosure, including, e.g. ASTM D7060.

Example 2

Figure 5:
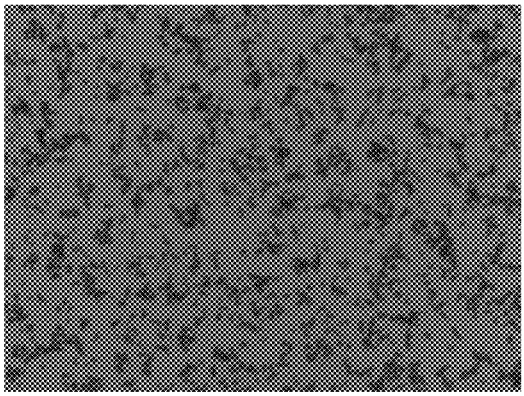
FIG. 5 shows a blend of marine fuel composition with marine gas oil (MGO) from Example 2, which is observed under microscopic magnification of 100×

For comparison purposes, a marine gasoil (MGO with 0.5% m/m sulfur) was used because certain properties of fatty acids alkyl esters (e.g. density, viscosity, combustion properties, etc.) are similar to those of MGO but they are nevertheless different components based on the process from which each is produced and also on a molecular level with the fatty acid alkyl esters containing an ester functional group while MGO does not. A sample of a marine fuel composition (with density of 0.976 kg/1, kinematic viscosity @ 50° C. of 195 cSt, sulphur content of 0.47% m/m and pour point of −12° C.) comprising the following components 75% m/m VTB, 15% m/m cracked residue and 10% m/m slurry oil was blended with MGO (which has a density of 0.8272 g/cc, kinematic viscosity of 1.949 cSt, Sulphur content of 0.5% m/m and a pour point of −18° C.) in 1:1 ratio (by volume). Referring to FIG. 5, the resulting blend of the fuel composition and MGO was observed under a microscopic magnification of 100×.

Figure 6:
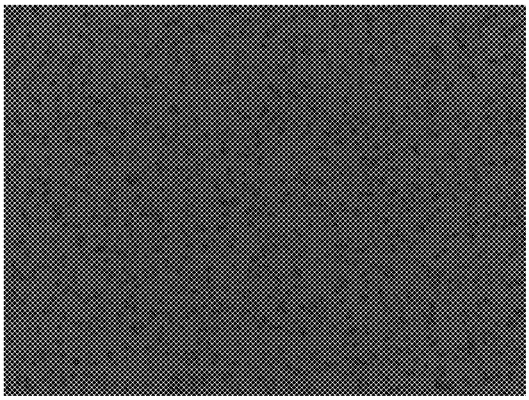
FIG. 6 shows a blend of the marine fuel composition from FIG. 5 but with a fatty acids alkyl esters instead of MGO, which was observed under a microscopic magnification of 100×.

The same fuel composition was blended with UCOME in the same 1:1 ratio (by volume). Referring to FIG. 6, the resulting blend of the fuel composition and UCOME was observed under a microscopic magnification of 100× for comparison purposes. As can be seen, FIG. 5 shows black fragments that are larger than the black fragments in FIG. 6, which indicates that adding MGO to a fuel composition results in a greater amount of flocculated and precipitated asphaltenes as compared to the addition of a fatty acids alkyl esters in the same amount. The stability ratio of the blends of FIGS. 5 and 6 were determined according to ASTM D7060 method. The stability ratio for the MGO containing blend of FIG. 5 is 0.77 while the stability ratio for the UCOME containing blend of FIG. 6 is 1.03. According to the ASTM D7060, blends with a stability ratio greater than 1 are considered stable while a stability ratio of less than 1 are considered unstable. As such the ASTM D7060 stability ratios support the observations of instability in FIG. 5 with the MGO as compared to the more stable blend with UCOME in FIG. 6.

The increase in stability reserve and/or stability of the residual fuel composition through at least use of the fatty acid alkyl ester component instead of another component that may have certain similar properties (such as MGO) can at least be measured by a decrease in the amount of asphaltenes flocculation and/or precipitation in the residual fuel composition comprising the fatty acids alkyl esters component (FIG. 6) when compared to the amount off asphaltenes flocculation and/or precipitation in the same residual fuel composition except that it contains MGO instead (FIG. 5). The decrease in the amount of asphaltenes flocculation and/or precipitation can be measured or determined at least through observation under a microscope, such as under 100× magnification here or by any other suitable methods known to one of ordinary skill, such as those mentioned in this disclosure, including, e.g., ASTM D7060.

Example 3

Also, for comparison purposes, a paraffinic hydrocarbon-cetane (C16H34) was added to a stable sample of residual (VTB) hydrocarbon component in an amount that is sufficient to trigger flocculation and precipitation of asphaltenes (such as an amount of cetane 30% m/m). This is because it is known that blending of paraffinic hydrocarbons like cetane (C16H34) to a stable residual hydrocarbon component or a residual marine fuel composition worsens the stability of the stream and when the cetane concentration exceeds a certain threshold flocculation and precipitation of asphaltenes occurs.

Figure 7:
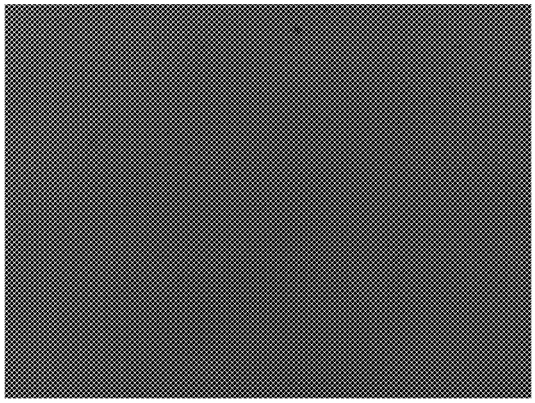
FIG. 7 shows a stable residual fuel composition from Example 3, which is observed under microscopic magnification of 100×.
Figure 8:
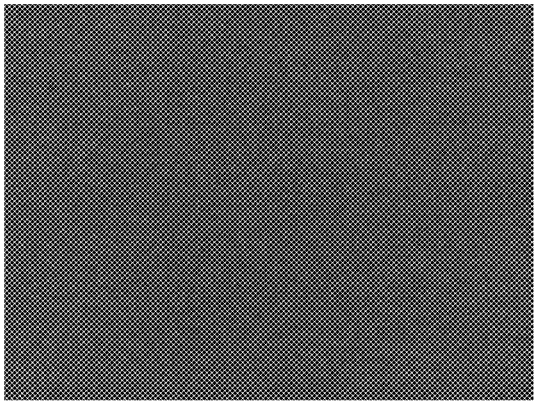
FIG. 8 shows a blend of the residual fuel oil from FIG. 7 and cetane, which is observed under microscopic magnification of 100×.

The sample of residual hydrocarbon component in this Example 3 was observed under a microscope (100× power) prior to the addition of cetane, which is shown in FIG. 7. As can be seen, FIG. 7 shows a "smooth" texture with minimal darker regions or black fragments, which indicates that the component is stable. After cetane (30% m/m) was added, the blend of residual hydrocarbon component and cetane was observed under a microscope (100× power), which is shown in FIG. 8. As can be seen, FIG. 8 shows a "rougher" texture with increased darker regions spread throughout more similar to FIG. 1 (another unstable sample), which indicates increased flocculation and precipitation of asphaltenes, thereby reflecting instability of the blend containing the cetane.

Figure 9:
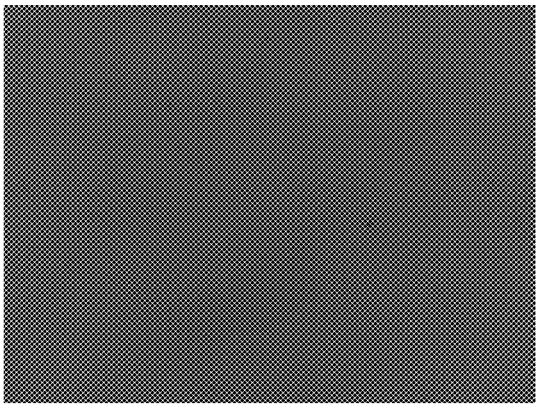
FIG. 9 shows a resulting blend of (i) the residual fuel oil from FIG. 7 to which fatty acids alkyl esters component was blended and (ii) cetane, which is observed under microscopic magnification of 100×.

On the other hand, referring to FIG. 9, adding cetane in the same proportion to a blend of the residual hydrocarbon component (VTB) that already contains 20% m/m of UCOME does not cause flocculation and precipitation of asphaltenes. This final blend of the residual hydrocarbon component and 20% m/m of UCOME to which cetane was added was observed under a microscope (100× power), which is shown in FIG. 9. As can be seen, the blend has a "smoother" appearance similar to FIG. 7, which reflects a similar minimal amount of flocculated asphaltenes as compared to FIG. 8, indicating increased stability of the fuel by the addition of the fatty acids alkyl esters even with the same proportion of cetane added.

Figure 10:
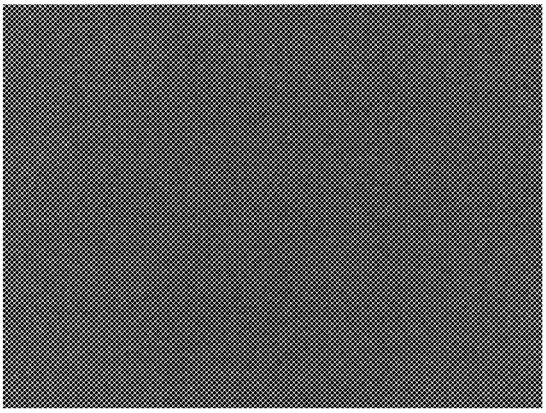
FIG. 10 shows the blend from FIG. 8 to which fatty acids alkyl esters was added, which blend is observed under microscopic magnification of 100×.

It should be mentioned however that the fatty acids alkyl esters do not exhibit the same stabilizing effect observed in FIG. 9 if it is added after the flocculation and precipitation of asphaltenes has already occurred. A fatty acids alkyl esters (density of 0.879 kg/1, kinematic viscosity @ 50° C. of 4.361 cSt, and flash point of 158.5° C.) in an amount of 20% m/m was added to the blend of FIG. 8, which contains the residual hydrocarbon component (VTB) and cetane, which final blend was observed under a microscope (100× power), which is shown in FIG. 10. This blend of fatty acids alkyl esters, residual hydrocarbon component, and cetane in FIG. 10 contains similar components in similar proportion as the blend in FIG. 9. However, as can be seen, the blend of FIG. 10 has a "rougher" texture similar to that seen in FIG. 8, which indicates that once the asphaltenes have flocculated and precipitated (as is the case of FIG. 8), the addition of FAME does not dissolve back asphaltenes that have already been flocculated and precipitated.

The increase in stability reserve and/or stability of the residual hydrocarbon component through use or at least blending of the fatty acid alkyl ester component before another component that decreases the asphaltene solvency power of the residual fuel composition (such as cetane) is added can at least be measured by a decrease in the amount of asphaltenes flocculation and/or precipitation in the residual fuel composition (FIG. 9) when compared to the amount off asphaltenes flocculation and/or precipitation in the same residual hydrocarbon component except without the fatty acids alkyl esters component (FIG. 8) or that the fatty acids alkyl esters component was added after the cetane (FIG. 10). The decrease in the amount of asphaltenes flocculation and/or precipitation can be measured or determined at least through observation under a microscope, such as under 100× magnification here or by any other suitable methods known to one of ordinary skill, such as those mentioned in this disclosure, including, e.g., ASTM D7060.

Example 4

Figure 11:
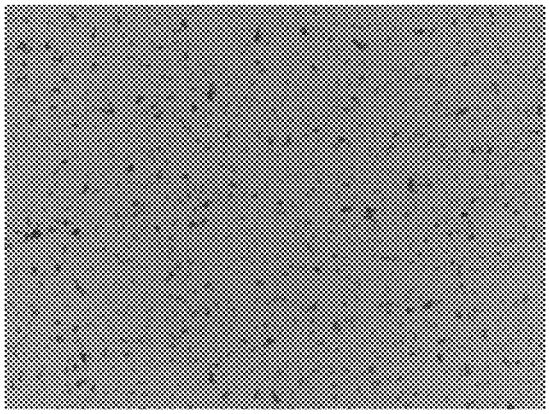
FIG. 11 shows a blend of two incompatible residual fuel compositions from Example 4: fuel composition A and fuel composition B, which is observed under microscopic magnification of 100×.

FIG. 11 shows a 1:1 blend (by volume) of two incompatible residual fuel compositions: fuel composition A containing 67% m/m short residue (VTB) and 33% m/m ethylene cracker gasoil, where fuel composition A has a density of 0.910 kg/1, kinematic viscosity @ 50° C. of 7.390 cSt, sulphur content of 0.46% m/m and pour point of 27° C. and fuel composition B containing 45% m/m VTB, 20% m/m vacuum gasoil (VGO) and 35% m/m ultra low sulphur diesel (ULSD), where fuel composition B has a density of 0.878 kg/1, kinematic viscosity @ 50° C. of 9.344 cSt, sulphur content of 0.46% m/m and pour point of −15° C., which blend is observed under microscopic magnification of 100×. This Example 4 shows use of the fatty acids alkyl esters component to improve the stability reserve (or tolerance) or stability or compatibility of a fuel oil composition, so that higher amounts of potentially incompatible residual fuel compositions may be combined with one another.

Fuel compositions A and B were stable prior to being combined with one another. As can be seen in FIG. 11, the blend of fuel compositions A and B, however, became unstable as indicated by the visible asphaltene flocculation and precipitation (dark fragments or regions) under 100× magnification, which indicates instability as the flocculated and/or precipitated asphaltenes can lead to sludge formation.

Figure 12:
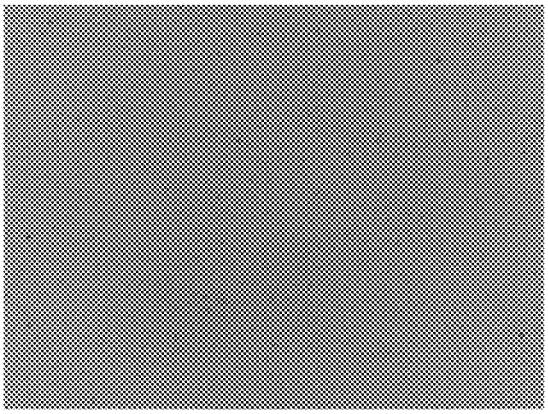
FIG. 12 shows a blend of fuel composition A from FIG. 11 with a fatty acids alkyl esters component added before fuel composition B from FIG. 11 is added, which resulting blend is observed under microscopic magnification of 100×.

Referring to FIG. 12, 20% v/v of a fatty acids alkyl esters component was added to fuel composition A before the fuel composition B was added to the combination of fuel composition A and the fatty acids alkyl esters, where the ratio of (i) the combination of fuel A and fatty acids alkyl esters and (ii) fuel B was 1:1 by volume. FIG. 12 shows the resulting blend under 100× magnification. As can be seen in FIG. 12, the amount of flocculated and/or precipitated asphaltenes in FIG. 12 is less than what can be seen in FIG. 11, indicating that the addition of a fatty acids alkyl esters component to a stable fuel composition before the addition of an incompatible fuel composition results in a blend that is more stable than without the fatty acids alkyl esters. That is, the stability reserve of residual fuel A was increased by the addition of the fatty acids alkyl esters or that the stability of the final blend of fuel composition A and fuel composition B was increased.

The increase in stability reserve, stability, and/or compatibility of the residual fuel composition or final blend of two different fuel compositions through use or at least blending of the fatty acid alkyl ester component with a stable residual fuel composition before at least one other fuel composition that decreases the asphaltene solvency power of the residual fuel composition is added can at least be measured by a decrease in the amount of asphaltenes flocculation and/or precipitation in the final blend or blended residual composition (FIG. 12) when compared to the amount of asphaltenes flocculation and/or precipitation in the same final blend or blended residual fuel composition except that the fatty acids alkyl esters component was added after the two fuel compositions without containing any fatty acids alkyl esters component were blended (FIG. 11). The decrease in the amount of asphaltenes flocculation and/or precipitation can be measured or determined at least through observation under a microscope, such as under 100× magnification here or by any other suitable methods known to one of ordinary skill, such as those mentioned in this disclosure, including, e.g. ASTM D7060.

Accordingly, optionally for the uses, methods, and/or compositions provided herein, (i) the residual hydrocarbon component blended with the fatty acids alkyl ester component before said another component is added has an asphaltenes solubility level, (ii) the residual hydrocarbon component without the fatty acids alkyl ester component has an asphaltenes solubility level, and (iii) the residual hydrocarbon component blended with the fatty acids alkyl ester component after said another component is added has an asphaltenes solubility level, and the asphaltenes solubility level of (i) is greater than the asphaltenes solubility level of either (ii) or (iii); and Optionally for the uses, methods, and/or compositions provided herein, (i) the blended residual fuel composition comprising the stable residual fuel composition blended with the fatty acids alkyl ester component before the at least one other fuel composition is added has an asphaltenes solubility level, (ii) the blended residual fuel composition comprising with the stable residual fuel composition without the fatty acids alkyl ester component has an asphaltenes solubility level, and (iii) the blended residual fuel composition comprising the stable residual fuel composition blended with the fatty acids alkyl ester component after the at least one other fuel composition is added has an asphaltenes solubility level; wherein the asphaltenes solubility level of (i) is greater than the asphaltenes solubility level of either (ii) or (iii).

Optionally for the for the uses, methods, and/or compositions provided herein, the asphaltenes solubility is determined by ASTM D4740 and/or the stability is determined using the ASTM D7060 method. Optionally for the uses, methods, and/or compositions provided herein, the increase in stability reserve, stability, and/or compatibility of the residual hydrocarbon component and/or residual fuel composition or final blend of two different fuel compositions through the uses and/or methods described herein can at least be measured or determined by a decrease in the amount of asphaltenes flocculation and/or precipitation in the blends and/or components with the fatty acids alkyl esters component, particularly when added before the addition of another component that can decrease the asphaltene solvency power of the residual hydrocarbon component or residual fuel composition respectively. The decrease in the amount of asphaltenes flocculation and/or precipitation can be measured or determined at least through observation under a microscope, such as under 100× magnification here or by any other suitable methods known to one of ordinary skill, such as those mentioned in this disclosure, including, e.g., ASTM D7060.

Optionally for the uses, methods, and/or compositions provided herein, the non-hydroprocessed component is selected from the group consisting of light cycle oil (LCO), heavy cycle oil (HCO), fluid catalytic cracking (FCC) cycle oil, FCC slurry oil, pyrolysis gas oil, cracked light gas oil (CLGO), cracked heavy gas oil (CHGO), pyrolysis light gas oil (PLGO), pyrolysis heavy gas oil (PHGO), pyrolysis residue (ECR), thermally cracked residue, thermally cracked heavy distillate, coker heavy distillates, vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), and any combination thereof. Optionally, the hydro-processed component is selected from a group consisting of low-sulfur diesel (LSD) having a sulphur content of less than 500 ppmw, ultra low-sulfur diesel (ULSD) having a sulphur content of less than 15 ppmw; hydrotreated LCO; hydrotreated HCO; hydrotreated FCC cycle oil; hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate, hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms, hydrotreated thermally cracked VGO, and hydroprocessed DAO, including hydrotreated hydrocracker DAO, and any combination thereof.

Optionally, for the uses, methods, and/or compositions provided herein, the fatty acids alkyl esters component is a product of trans-esterification of vegetable oils and/or animal fats with an alcohol, or the esters of a fatty acids derived from naturally occurring oils and fats, and an alcohol. Optionally, the oils and/or fats are selected from the group consisting of Soy Oil, Palm Oil, Rapeseed Oil, Linseed Oil, Coconut Oil, Corn Oil, Cotton Oil, Cooking Oils, including Used Cooking Oils, Waste Cooking Oils, Sunflower Oil, Safflower Oil, Algae Oil, Tallow, Lard, Yellow Grease, Brown Grease, Fish Oils, and any combination thereof. Optionally, the alcohol is selected from the group consisting of linear, branched, alkyl, aromatic, primary, secondary, tertiary, and polyols.

Optionally, for the uses, methods, and/or compositions provided herein, the residual fuel composition has a sulphur content in a range of about 0.05 to about 3.5% m/m. Optionally, for the uses, methods, and compositions provided herein, the residual fuel composition exhibits at least one or all of the following: a hydrogen sulfide content of at most 2.0 mg/kg; an acid number of at most 2.5 mg KOH per gram; a sediment content of at most 0.1% m/m; a water content of at most 0.5% v/v; an ash content of at most 0.15 m/m; a density at 15° C. in a range of 0.870 to 1.010 g/cm$^3$, a kinematic viscosity at 50° C. in a range of 1 to 700 cSt, a pour point in the range of −30 to 35° C., and a flash point in a range of 60° C. to 130 V. Optionally, for the uses, methods, and compositions provided herein, the Atmospheric Tower Bottoms (ATB) residues exhibit at least one or all of the following: a pour point in a range of −19.0 to 64 V, a flash point in a range of 80 to 213° C.; an acid number of up to 8.00 mg KOH/g; a density at ~15° C. of at most about 1.0 g/cc; and a kinematic viscosity at ~50° C. in a range of 1.75 to 15000 cSt, and the VTB residues exhibit at least one of the following: a density at 15° C. in a range of 0.8 to 1.1 g/cc; a pour point in a range of −15.0 to 95° C., a flash point in a range of 220 to 335° C.; an acid number of up to 8.00 mg KOH/g; and a kinematic viscosity at 50° C. in a range of 3.75 to 15000 cSt. Optionally, for the uses, methods, and compositions provided herein, the ATB residues comprise greater than 70% m/m, greater than 80% m/m, or greater than 90% m/m hydrocarbons having carbon numbers greater than C20.

Therefore, embodiments of the present invention are well adapted to attain the ends and advantages mentioned, as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, substituted, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount whether accompanied by the term "about" or not. In particular, the phrase "from about a to about b" is equivalent to the phrase "from approximately a to b," or a similar form thereof. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

We claim:

1. A method to improve or maintain stability and/or compatibility of a residual hydrocarbon marine fuel component or a residual marine fuel composition in a marine fuel composition, wherein the marine fuel composition meets the requirements of ISO 8217:2017 specification, said method comprising:

(a) blending at least 5% m/m to 20% m/m of a fatty acid alkyl ester component with a residual marine fuel composition comprising (i) at least 5% m/m to 95% m/m of a residual hydrocarbon marine fuel component selected from a group consisting of an atmospheric tower bottoms (ATB) residue, a vacuum tower bottoms residues (VTB), and any combination thereof and (ii) up to 90% m/m of a non-hydroprocessed hydrocarbon component, a hydroprocessed hydrocarbon component, or any combination thereof, wherein the fatty acids alkyl ester component is blended with the residual marine fuel composition before at least one other fuel composition or fuel component that decreases the asphaltenes solvency power of the residual marine fuel composition is added thereto and the combination of the residual marine fuel composition and the at least one other fuel composition or fuel component forms a blended residual marine fuel composition, and wherein at least the blending of the fatty acids alkyl esters component before the at least one other fuel composition ox fuel component is added increases the compatibility of said residual marine fuel composition and/or the stability of the blended residual marine fuel composition, wherein the increase in compatibility of the residual marine fuel composition and/or the stability of the blended residual marine fuel composition is at least measured by a decrease in the amount of asphaltenes flocculation and/or precipitation in the blended residual marine fuel composition relative to the amount of asphaltenes flocculation and/or precipitation in the same blended residual marine fuel composition which (i) does not comprise the fatty acid alkyl ester component or (ii) comprises the fatty acid alkyl ester component blended after the at least one other fuel composition or fuel component has been added to the residual marine fuel composition, wherein stability is determined using the ASTM D7060 method;

wherein the non-hydroprocessed component is selected from the group consisting of light cycle oil (LCO), heavy cycle oil (HCO), fluid catalytic cracking (FCC) cycle oil, FCC slurry oil, pyrolysis light gas oil, cracked light gas oil (CLGO), cracked heavy gas oil (CHGO), pyrolysis light gas oil (PLGO), pyrolysis heavy gas oil (PHGO), pyrolysis residue (ECR), thermally cracked residue, thermally cracked heavy distillate, coker heavy distillates, vacuum gas oil (VGO), coker diesel, coker gas oil, coker VGO, thermally cracked VGO, thermally cracked diesel, thermally cracked gas oil, Group I slack waxes, lube oil aromatic extracts, deasphalted oil (DAO), and any combination thereof;

and wherein the hydro-processed component is selected from a group consisting of low-sulphur diesel (LSD) having a sulphur content of less than 500 ppmw, ultra low-sulfur diesel (ULSD) having a sulphur content of less than 15 ppmw; hydrotreated LCO, hydrotreated HCO; hydrotreated FCC cycle oil, hydrotreated pyrolysis gas oil, hydrotreated PLGO, hydrotreated PHGO, hydrotreated CLGO, hydrotreated CHGO, hydrotreated coker heavy distillates, hydrotreated thermally cracked heavy distillate, hydrotreated coker diesel, hydrotreated coker gas oil, hydrotreated thermally cracked diesel, hydrotreated thermally cracked gas oil, hydrotreated VGO, hydrotreated coker VGO, hydrotreated residues, hydrocracker bottoms, hydrotreated thermally cracked VGO, and hydroprocessed DAO, including hydrotreated hydrocracker DAO, and any combination thereof, wherein the fatty acid alkyl ester component is a product of trans-esterification of vegetable oils and/or animal fats with an alcohol, or the esters of fatty acids derived from vegetable oils and/or animal fats, and an alcohol (esterification), wherein said vegetable oils and/or animal fats are selected from the group consisting of Soy Oil, Palm Oil, Rapeseed Oil, Linseed Oil, Coconut Oil, Corn Oil, Cotton Oil, Cooking Oils, Used Cooking Oils, Waste Cooking Oils, Sunflower Oil, Safflower Oil, Algae Oil, Tallow, Lard, Yellow Grease, Brown Grease, Fish Oils, and any combination thereof.

2. The method of claim 1, wherein: (i) the blended residual marine fuel composition comprising the residual marine fuel composition blended with the fatty acid alkyl ester component before the at least one other fuel composition or fuel component is added has an asphaltenes solubility level, (ii) the blended residual marine fuel composition comprising with the stable residual marine fuel composition without the fatty acid alkyl ester component has an asphaltenes solubility level, and (iii) the blended residual marine fuel composition comprising the stable residual marine fuel composition blended with the fatty acids alkyl ester component after the at least one other fuel composition or fuel component is added has an asphaltenes solubility level; wherein the asphaltenes solubility level of (i) is greater than the asphaltenes solubility level of either (ii) or (iii), wherein the asphaltenes solubility is determined by ASTM D4740.

3. The method of claim 1 wherein the residual marine fuel composition has a sulphur content in a range of about 0.05 to about 3.5% m/m.

4. The method of claim 1, wherein the residual marine fuel composition exhibits at least one of the following:

a hydrogen sulfide content of at most 2.0 mg/kg; an acid number of at most 2.5 mg KOH per gram; a sediment content of at most 0.1% m/m; a water content of at most 0.5% v/v; an ash content of at most 0.15% m/m; a density at 15° C. in a range of 0.870 to 1.010 g/cm$^3$, a kinematic viscosity at 50° C. in a range of 1 to 700 cSt, a pour point in the range of −30 to 35° C., and a flash point in a range of 60° C. to 130° C.

5. The method of claim 1, wherein the Atmospheric Tower Bottoms (ATB) residues exhibit at least one of the following: a pour point in a range of −19.0 to 64° C., a flash point in a range of 80 to 213° C.; an acid number of up to 8.00 mg KOH/g; a density at ~15° C. of at most about 1.0 g/cc; and a kinematic viscosity at ~50° C. in a range of 1.75 to 15000 cSt, and wherein the VTB residues exhibit at least one of the following: a density at 15° C. in a range of 0.8 to 1.1 g/cc; a pour point in a range of −15.0 to 95° C. a flash point in a range of 220 to 335° C.; an acid number of up to 8.00 mg KOH/g; and a kinematic viscosity at 50° C. in a range of 3.75 to 15000 cSt.

6. The method of claim 1 wherein the said vegetable oils and/or animal fats are selected from Used Cooking Oils.

7. The method of claim 1 wherein the fatty acid alkyl ester component is blended at a level of from at least 10% m/m to 20% m/m.

8. The method of claim 1 wherein the residual hydrocarbon marine fuel component is a vacuum tower bottoms residue (VTB).

* * * * *